US005515787A

United States Patent [19]

Middleton

[11] Patent Number: 5,515,787

[45] Date of Patent: May 14, 1996

[54] TUBULAR PROJECTILE

[76] Inventor: Derrick Middleton, 1305 Redbank Cres., Oakville, Ont., Canada, L6H 1Y4

[21] Appl. No.: 369,511

[22] Filed: Jan. 6, 1995

[51] Int. Cl.[6] ..... F42B 10/34; F42B 14/06

[52] U.S. Cl. ..... 102/503; 102/439; 102/509; 102/521

[58] Field of Search ..... 102/439, 448, 102/501, 503, 507–510, 520–523

[56] References Cited

U.S. PATENT DOCUMENTS

| | | | |
|---|---|---|---|
| 219,840 | 9/1879 | Winchester | 102/509 |
| 590,428 | 9/1897 | Bennett | 102/503 |
| 2,669,930 | 2/1954 | Darby et al. | 102/523 |
| 3,726,231 | 4/1973 | Kelly et al. | 102/439 |
| 4,301,736 | 11/1981 | Flatau et al. | 102/503 |
| 5,016,538 | 5/1991 | Sowash | 102/439 |
| 5,175,389 | 12/1992 | Kramer et al. | 102/521 |
| 5,263,418 | 11/1993 | Dippold et al. | 102/521 |
| 5,275,110 | 1/1994 | Flatau | 102/503 |
| 5,339,743 | 8/1994 | Scarlata | 102/439 |

FOREIGN PATENT DOCUMENTS

| | | | |
|---|---|---|---|
| 2396948 | 2/1979 | France | 102/503 |
| 305152 | 4/1955 | Switzerland | 102/522 |

*Primary Examiner*—Harold J. Tudor
*Attorney, Agent, or Firm*—R. Craig Armstrong

[57] ABSTRACT

An improved tubular projectile is described wherein an effective balance has been obtained between the design parameters of reduced mass/reduced aerodynamic drag, flight characteristics, and high energy transfer upon impact. An elongate tubular projectile is provided with an axial passageway, with a central section of generally uniform diameter and flared ends. Slots are cut into the leading end to assist with expansion upon impact. The tubular projectile can be used in sabot type, ammunition, full bore shotgun ammunition, and in conventional case type rifle ammunition.

15 Claims, 3 Drawing Sheets

TUBULAR PROJECTILE

BACKGROUND OF THE INVENTION

This invention relates to ammunition for firearms, and in particular to tubular projectiles for small arms such as rifles and shotguns.

Tubular projectiles have been known for some time and have been found to provide significant advantages over conventional ammunition in certain applications. Conventional ammunition typically comprise a solid mass with a rounded nose or ogive portion, a generally cylindrical body, and an aft or tail portion terminating abruptly in a flat surface normal to the longitudinal centre axis of the cylindrical body.

The aerodynamics (ballistics) of solid projectiles such as conventional ammunition is fairly well understood. The relatively blunt nose produces a very high drag force and a parabolic shock wave when the projectile is fired at high velocity. The blunt tail section produce considerable turbulence behind the projectile which translates into further drag from conversion of energy from the projectile to the surrounding mass of air.

While the aerodynamics of tubular projectiles is generally less well understood than those of solid projectiles, the hollow centre passage in tubular projectiles has been found to address some of the problems with conventional ammunition. In particular, tubular projectiles have been found to have reduced total drag due to the hollow centre passage and thereby reduced frontal area, which in turn generally leads to better flight characteristics and increased impact velocities.

From a technical ballistics perspective it has been speculated by Flatau in U.S. Pat. No. 4,301,736 that the normal bow shock wave found in solid ammunition is not present under ideal supersonic flow conditions in tubular projectiles, resulting in a dramatic reduction in total drag force. This flow condition requires certain precise combinations with regards to cross sectional size of the internal and external surfaces of the tubular projectile and the launching or firing velocity.

It has been further proposed that after a tubular projectile is fired and thus begins to decelerate, that the internal air flow can change dramatically whereby a bow shock wave appears at the nose of the projectile and subsonic flow occurs through the centre passage. This condition is called "choking" and is accompanied by a sharp increase in drag. This can result in a tubular projectile beginning to "tumble" in flight causing significant loss of accuracy and range.

To control this phenomenon, it is desired to design a tubular projectile so that the bow wave is "swallowed" and remains thus through a certain range of velocities. This obviously is an important design consideration which must be addressed by those seeking to improve this type of ammunition.

There are other design trade offs or compromises inherent with tubular projectiles. These also have likely limited the range of uses for tubular projectiles to date. Paramount among these are the reduced mass of the projectile and the sometimes less than optimal energy transfer to the target due to the "sharper" leading edge. Most attempts to improve tubular projectiles have focused on minimizing these less than desirable effects, while retaining the inherent advantages with this type of ammunition design.

Tubular projectiles have been known to be used in a variety of ammunition types. These would include conventional primed case ammunition for rifles, and full bore shotgun ammunition.

One type of ammunition that has not been known to utilize tubular projectiles is sub-calibre projectile case-type ammunition for shotguns, sometimes called sabot ammunition.

Solid projectile sabot ammunition has been found particularly popular for deer hunting as many jurisdictions, particularly in the United States, prohibit the use of rifles for deer hunting. Sabots have been found to offer better range and overall performance than most other standard shotgun ammunition.

"Sabot" does not actually refer to the entire ammunition type, but is actually a term referring only to a sleeve, shim or other support to centre a sub-calibre projectile in a gun bore. Often sabots are found in multiple sections and most commonly in sabot segments or sabot halves. As the term is commonly used however, sabot may refer to either the sleeves, shims etc., or the entire ammunition type. Upon firing, the sabot halves are intended to separate from the projectile after the entire assembly leaves the gun muzzle. A number of different sabot systems have been developed, but it has been found that such systems for use in a shotgun, i.e., where it is desired to use a single sub-calibre bullet and a sabot loaded into a standard shotshell, could be substantially improved, particularly in terms of accuracy and flight characteristics.

While the following description may make specific reference to shotguns and/or shotgun shells, it is not intended that the invention be so limited.

Some of the problems encountered in providing a sabot bullet for a shotgun include the fact that while standards do exist, there still exists a large number of older firearms with uncertain and nonstandardized variations in shotgun bore diameters, length, configurations and interior taper or choke. The shellcase diameter will normally exceed the bore diameter or the choke, and therefore any load component, e.g., projectile, wadding, sabot etc., must either be of a lesser diameter than the minimum choke diameter, or be formed of a material which may compress or otherwise be capable of deformable flow to pass through the choke.

Another problem that must be considered is that if a sub-calibre bullet is loaded in a shot shell over a conventional wad column, the inertia of the bullet will cause it to penetrate the wadding when the shell is fired. However, even if a suitable wad material was available, which would avoid penetration due to the bullet inertia, the same inertia or setback forces would deform a projectile made of lead or a lead alloy, thereby necessitating a steel bullet which sacrifices density and ease of fabrication. Attempts to solve this problem have included the use of an "air wedge". This is typically a soft plastic disk which is inserted into the back of the projectile, which seals against the projectile when it is fired.

The setback forces which would deform a projectile are substantial, and if a shotgun projectile is only supported around its circumference with a sabot of desirably light weight and compressible material, the inertial forces have been heretofore considered a difficult problem to solve.

A partial solution to the above problems employing solid projectile sabot slugs is found in U.S. Pat. No. 3,726,231. This patent teaches a solution where the projectile-sabot configuration and relationship is such that about one-half of the face of the wadding is covered by the base of the bullet and the other half covered by the base of the sabot. The greater portion of the force imposed upon the sabot base is transferred to the forward portion of the projectile. Also, with matching the complementary confronting surfaces on the projectile and sabot, all axial forces resulting from setback are distributed evenly. This is generally accomplished by providing the projectile exterior with a medial portion of reduced diameter and then tapering outwardly towards the front and base portions thereof. The exterior surface of the sabot or sabot segments conform to such exterior projectile surface.

When the shell is fired, the inclined surfaces of the projectile and the sabot moving under setback stress, cause the segments of the sabot to spread. This allows the projectile-sabot system to be made with a small enough diameter to be loaded into a shellcase of uncertain interior tolerances. The interior diameter of the shellcase may also be larger than the diameter of the barrel. In addition, the chamber of the gun may be of uncertain length as may the forcing cone. The sabot-projectile, by this expansion of the sabot segments, maintains a snug fit while travelling through these uncertain and varying tolerances. This is a desirable function of and "payload" (projectile, shot, slug, etc.) in a shotgun, otherwise the wadding may not effectively seal the propelling gases.

A further function of setback or inertial forces acting upon the engaged inclined surfaces of the projectile's exterior and the sabot's interior, is the unmistakable tendency of this action toward centring the mass of the projectile in the exact centre of the bore. While previous shotgun projectiles have been designed to compress or "swage down" as they passed through the choke of a shotgun, there has been no design provision to ensure they would do so evenly and keep their mass centred in the bore.

As the sabot-projectile travels down a shotgun bore, a point may be reached where the propellent has been entirely burned or at least is not longer effectively generating propelling gas. At this point, interior bore pressures will drop rapidly and the sabot-projectile will cease accelerating. Since the circumferential surface of the sabot is in contact with the gun bore, the resulting friction will make the sabot tend to travel more slowly than the projectile. In this circumstance, it will encounter a "set forward" instead of a setback of the projectile. Now the inclined surfaces on the rearward portion of the projectile and sabot become active again. Previously, these surfaces were active in keeping the projectile positioned and secured in the loaded shellcase and to keep the projectile from being moved forward in the sabot by surge pressures or the priming charge during the resistance the shot encounters while opening the shotshell crimp and/or entering the forcing cone.

As the projectile moves forward in the sabot, the projectile's sabot is prevented from premature separation. Also, the rear inclined surfaces perform the function of centring the projectile's mass in the bore, and keeping the sabot segments spread into snug, accuracy enhancing bore fit.

In addition to the foregoing, it is essential that the sabot-projectile leave the muzzle as a stable single projectile so as to avoid any tumbling tendency, and the entire assembly is weight stable. Next, after leaving the muzzle, it is necessary that the sabot segments separate from the projectile without imparting an uneven force as they drop away. The sabot segments, after initial opening, can only have contact with the projectile at a point rearward of the projectile's centre of balance. Further, the segments are usually constructed that as they open and begin to fall away, they will continue to turn outward and thus will not disrupt the stabilizing air flow over the projectile.

The projectile itself is constructed to not only cooperate with the sabot segments as above described, but is itself stabilized with its centre of balance or centre of gravity positioned forwardly of its geometric centre. Additionally, the projectile is aerodynamically stabilized, i.e., the least surface is presented to the air in straight forward flight.

The '231 patented slug became the industry standard for some time. Other manufacturers such as Winchester have modified the standard slug somewhat, however still as a solid projectile.

The present invention utilizes some of the concepts in the basic body shape of these prior art devices in its tubular projectile. Significant modifications are made to the leading edge and trailing edges to achieve proper aerodynamics. As well, a unique sabot half system has been developed to assist with proper release.

To date, none of the prior art tubular projectile devices nor the prior art solid projectile devices described or known have been able to achieve all of the performance characteristics of the present invention. Thus, present invention seeks to address the previous limitations and provide a generally improved tubular projectile, with a tubular projectile sabot being one particular application. Again, other types of applications such as full bore shotgun or conventional cased rifle ammunition are possible.

SUMMARY OF THE INVENTION

In accordance with the teachings of the present invention, an improved tubular projectile is provided which may be readily fired in a standard shotgun shell, rifle or the like.

It is an object of the invention to provide an improved tubular projectile which has reduced tail drag.

It is a further object of the invention to provide an improved tubular projectile for use in sabot ammunition, namely providing superior range and accuracy than heretofore known.

It is another object of the present invention to provide a combination of several separate features to effectively maximize aerodynamic characteristics and reduce ballistic drag and shockwave or head-pressure.

Thus, in accordance with the present invention, there is provided an elongate tubular projectile, having a longitudinal centre axis, and a generally cylindrical body having a leading end and a base. The body is radially constricted at a transverse plane closer to the base than the leading end, and the body tapers or diverges outwardly and forwardly towards the leading end and tapers outwardly and rearwardly towards the base. The projectile includes an axial passageway having a generally conical forward throat section of decreasing cross-sectional area, a central section with a smooth straight cylindrical inner surface of constant cross-sectional area, and a generally conical rearward diffuser section of increasing cross-sectional area. Slots are cut into the forward end of the tubular projectile to assist with expansion upon impact.

A Sabot/Projectile assembly is also described which utilizes this tubular projectile with modified sabot segments which include air vents to assist with release of the sabot segments from the projectile.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
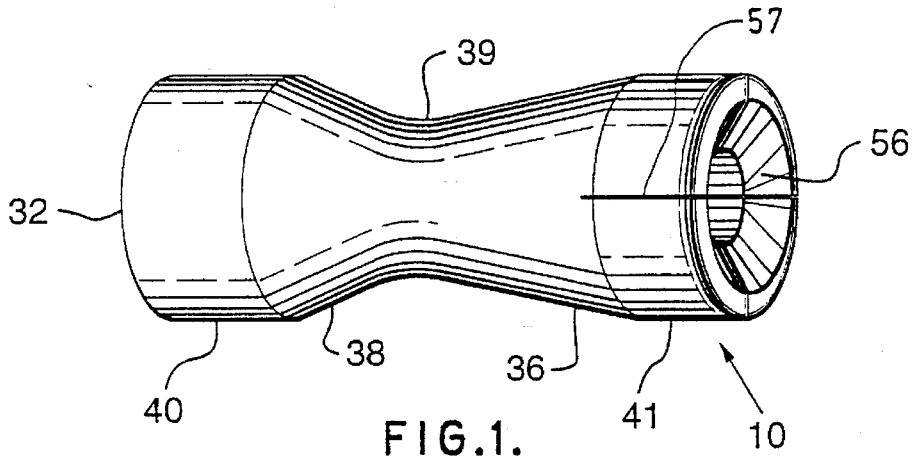
FIG. 1 is a perspective view of the tubular projectile.
Figure 2:
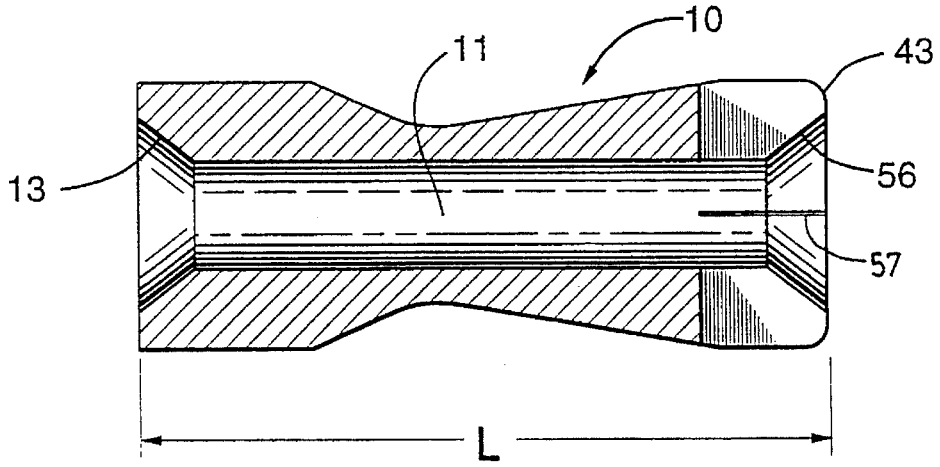
FIG. 2 is side sectional view of the tubular projectile.
Figure 3:
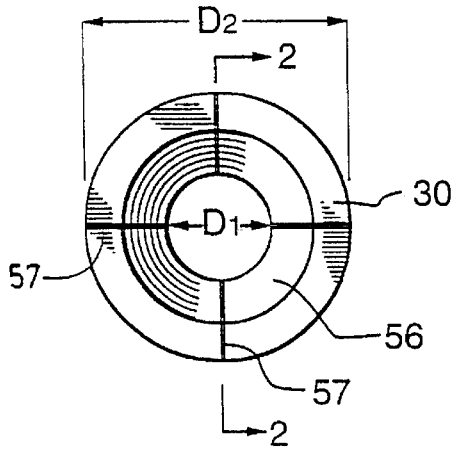
FIG. 3 is an end view of the tubular projectile.

Referring to FIGS. 1–3, the projectile 10 is seen to have a generally cylindrical body having a leading end 30 and a base 32. The body is radially constricted as indicated at waist portion 39 at a transverse plane closer to the base than the leading end, with the body tapering or diverging outwardly and rearwardly as shown at 38 towards base 32. Taper 38 could continue to the base, but for aerodynamic consideration terminates in a short cylindrical body portion 40 adjacent the base. The body also tapers or diverges outwardly and forwardly as shown at 36 towards leading end 30. Again, taper 36 could continue to the leading end, but for aerodynamic consideration terminates in a short cylindrical body portion 41 adjacent the leading end. Together the forward and rearward tapering sections of the body (also called divergent body sections) extend over a majority of the overall length of the projectile, as seen in the drawings. The leading end 30 of the projectile meets the short cylindrical body portion 41 at radius 43.

The projectile also includes an axial passageway 11, running generally the length of the projectile. The central part of the passageway is generally uniform in diameter, having diameter D1, versus the overall diameter of the projectile D2. This central part of the passageway extends over a majority of the overall length of the projectile, as seen in the drawings. Overall projectile length is shown as L.

The passageway is seen to flare outwardly, both towards the base of the projectile, shown at 13, and towards the leading end, shown at 56. Thus at the leading end there is provided a forward throat section of generally conical shape and of decreasing cross-sectional area which leads into the central part of the passageway which is generally of uniform diameter. Towards the base there is provided a rear diffuser section of increasing cross-sectional area and again being generally conical in shape.

This "flaring" of the ends of the axial passageway is achieved by simply drilling a countersink into the base 32 and the leading end 30 of the projectile 10. In the embodiment shown the countersink was set at approximately a 45 degree angle, although variations on this can be used.

In the preferred embodiment depicted both the front and rear conical sections commenced halfway between D1 and D2 being the inner and outer diameters of the projectile. It was found that if the countersink was not drilled deep enough, i.e. leaving a fairly "thick" leading edge that proper expansion was not achieved upon impact. Conversely, if the countersink was drilled too deeply i.e., leaving a fairly "thin" leading edge the projectile was found to be less stable in flight. Further modifications to the leading end include a rounded corner or radius 43 between the leading end and the short cylindrical body section 41. It was established that this rounded leading edge together with the proper depth countersink provided the optimum frontal area for ballistic performance.

It is necessary to flare the passageway at both the front and rear to channel air flow into the central passageway 11 at the leading end 30, and to assist in breaking up tail drag at the base 32.

The foregoing construction results in an aerodynamically stable projectile whose centre of gravity is positioned forwardly of the centre of the geometric mass.

Referring again to FIGS. 1–3, slots 57 and can be seen in the forward portion of the projectile. The slots are cut through the entire thickness of the material to the central passageway 11, and extend, from the leading end 30, through the short cylindrical forward section 41, and into the tapered body section 36.

In the embodiment shown, four identical slots have been used spaced equally around the circumference of the body. Projectiles with as few as two slots and projectiles with more than four slots have also been fabricated and tested and have met with acceptable results. However, the preferred embodiment shown herein has to date been found the best compromise, achieving proper performance while providing relatively easy manufacture.

The purpose of the slots 57 is to aid in the expansion of front portion of the projectile 10 upon impact. As noted in the background of the invention, traditionally tubular projectiles have suffered from low energy transfer at impact due to their inherently lower mass (because of the central passageway) and their relatively "sharp" leading edges. To improve energy transfer, slots 57 have been utilized and have been found to assist the expansion of the forward section of the projectile 41 upon impact.

Figure 8:
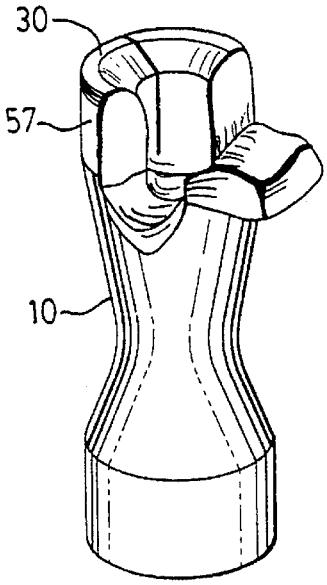
FIG. 8 is a perspective view of a sample projectile of the present invention after it contacted a practice target.
Figure 9:
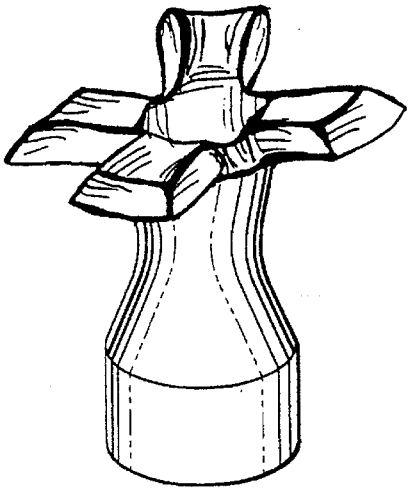
FIG. 9 is an idealized perspective view of the expansion of the projectile caused by the slots.

Referring to FIG. 8, there is shown a projectile that has expanded at its front section upon impacting a practice target. FIG. 9 shows an idealized view where the projectile expands uniformly in all directions upon impact. This would be the proposed result if perfectly uniform resistance was met by the projectile when impacting a target.

In both cases, it can be seen that the frontal area of the projectile expands dramatically upon impact, reducing the likelihood of a "pass-through" shot. Thus the maximum (total) transfer of energy to the target is achieved thereby eliminating one of the inherent problems with tubular projectiles.

To further assist in expansion the tubular projectile 10 is preferably fabricated of a reasonably soft material such as copper having a ROCKWELL hardness of RC 25–30. Use of a harder material was found to result in less than optimal expansion and thus reduced energy transfer into the target.

Figure 5:
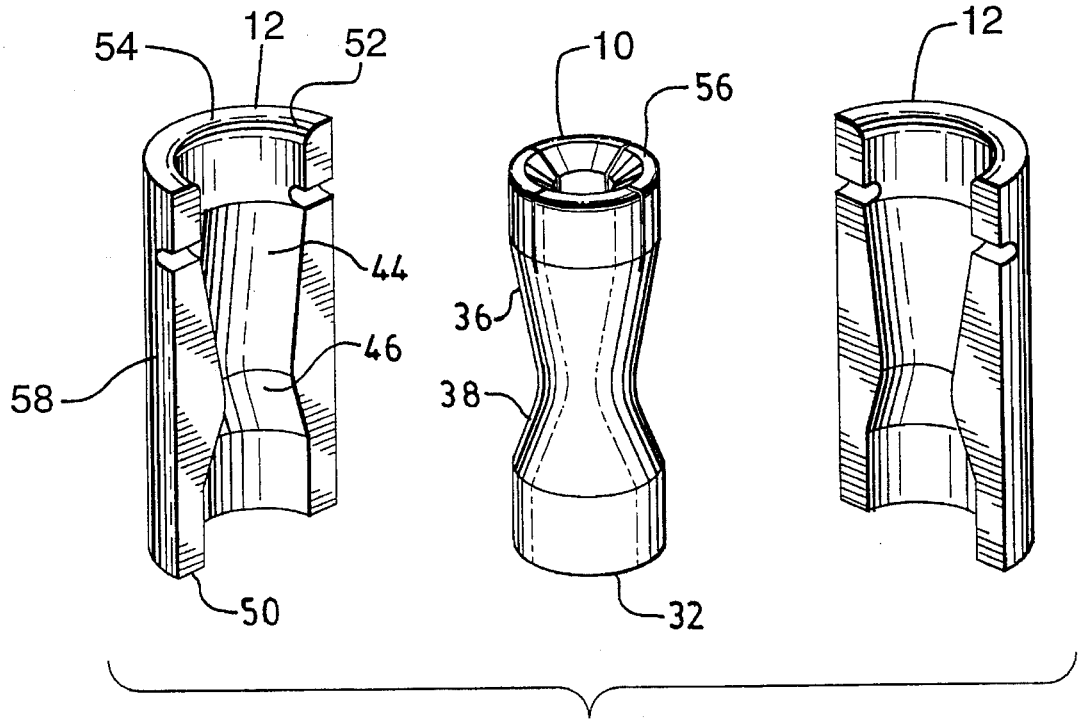
FIG. 5 is an exploded perspective view of the tubular projectile and sabot segments.
Figure 6:
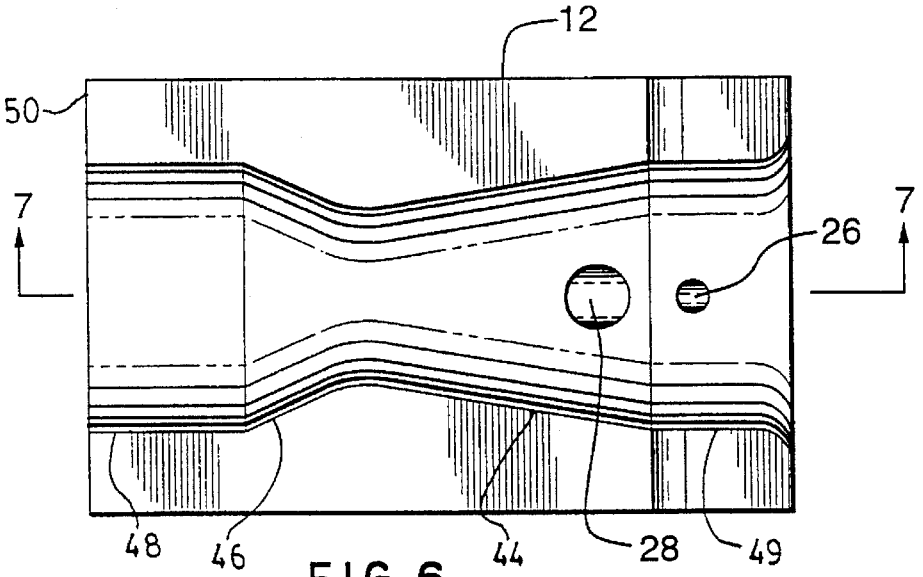
FIG. 6 is a perspective view of the inside of one of the sabot segments showing the air vents holes.
Figure 7:
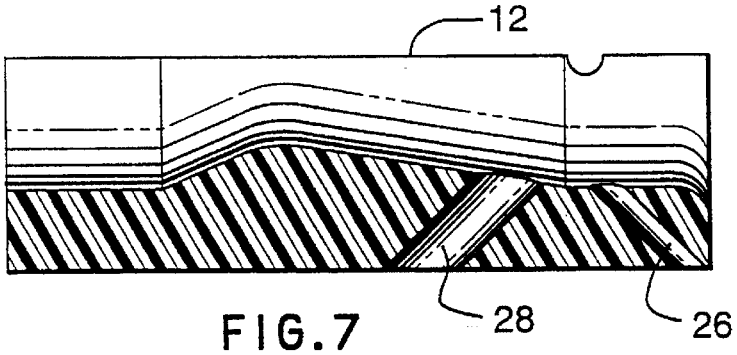
FIG. 7 is a cross section of one of the sabot segments showing the location and configuration of the air vents.

Referring now to FIGS. 5–7, the tubular projectile 10 is found in conjunction with sabot halves 12. The sabot is of generally annular configuration, with each of the two segments 12 extending for approximately one-half the circumference thereof. The inner surface of the segments match, and are complementary to, the outer adjacent portion of the projectile 10, thus having a forward tapered portion 44, a rear tapered portion 46, a rear cylindrical portion 48, a forward cylindrical position 49, and an annular base 50 coplanar with the projectile base 32. The forward end portions of the segments are provided with shoulders 52, thus radially spacing the distal annular end 54 of the segments from the frustro-conical nose 56 of the bullet. The outer surface 58 of each segment is here shown as a segment of a cylinder, but if desired, the segments could be formed of uniform thickness, and in such case, the outer surface would follow the inner surface. Irrespective of the outer configuration it is of course essential that at least a portion of the segments in one or more transverse planes maintain a snug fit when passing through the gun bore.

In this embodiment of the invention the ammunition includes a projectile 10 and a plurality of sabot segments 12, here shown as two in number, but it should be apparent to those schooled in the art that a larger number of segments could be provided. When in its operative assembled condition for firing, i.e., with the segments 12 positioned adjacent and around the projectile, the assembly is adapted for loading in a conventional shotgun shell 14 in place of the usual slugs or pellets.

Figure 4:
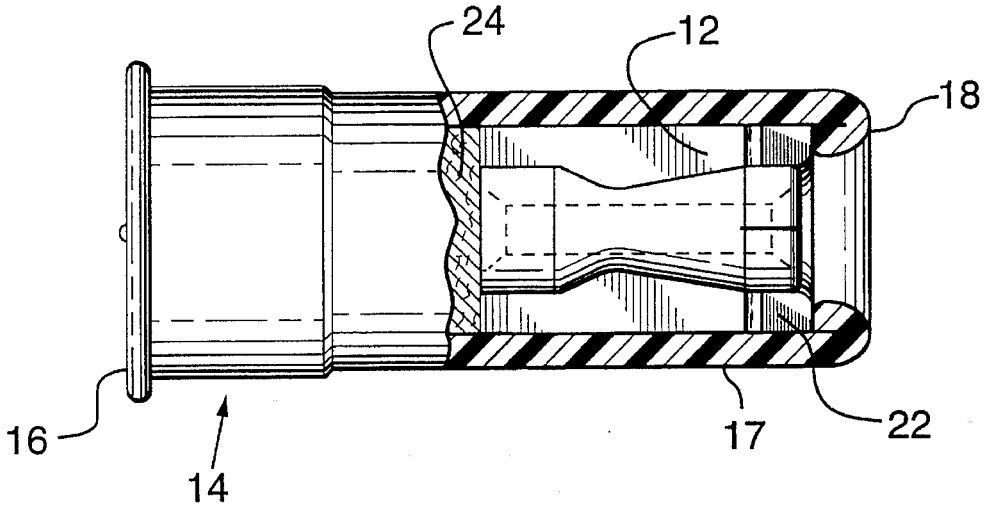
FIG. 4 is a side elevational view, partly in section of a conventional shotgun shell loaded with the tubular projectile of the present invention.

Referring to FIG. 4, a standard shotgun shell is shown utilizing the tubular projectile of the present invention. The shell includes a circular base 16, and a tubular body 17 terminating at its leading or forward end with an inwardly crimped curl 18 which holds the projectile and sabot assembly in the body. The charge is positioned in the shell chamber 22 adjacent the base 16 and forwardly of the charge is wadding 24 which transfers the explosive charge force to the projectile 10 in the chamber.

The length of the projectile 10 and sabot(s) 12 is such that they extend between the forward surface of the wadding 24 and the rear surface of crimped curl 18. The outer diameter of the sabot segments 12 when assembled with the projectile 10 will permit ready insertion of the assembly in the shell body 17 with a minimum of play therebetween.

With the sabot/projectile assembly loaded in the shotgun shell 14, and upon firing, a portion of the propulsion force is exerted on the base 32 of the projectile and the other portion exerted on the annular base 50 of the sabot, the exact apportionment of forces can be varied by the diameter of the projectile or its base area.

For example, with a 0.50 calibre projectile in a 12 gauge shell, there results a substantial equal division of propulsion force in the projectile and on the sabot segments. Due to the inter engagement of the projectile taper 36 and the sabot taper 44, the greater portion of the force exerted on the sabot base will be transferred to the forward portion of the projectile 10, a desired feature to overcome the setback forces on the heavier projectile. Such tapered surfaces also cause the sabot segments to spread under setback forces to insure a proper snug fit of the assembly in travelling through the gun barrel.

During the "set forward" phase of travel, as previously explained, the rear tapered surfaces 38 of the projectile and 46 of the sabot are effective to prevent the projectile from travelling faster than the sabot which has a frictional drag load imparted to it by contact with the gun bore. Such rear surfaces further centre the projectile's mass in the bore and maintain the sabot segments spread to maintain a snug fit with the bore.

When the assembly leaves the muzzle of the shotgun (not shown), the segments 12 will readily fall away from the projectile 10 without imparting any uneven force to the projectile, and without affecting the airflow over the projectile. With the slightest opening of the segments, the only further contact that a segment 12 can have with the projectile 10 is as a point rearwardly of the projectile's centre of balance. Prior to any separation, the sabot and projectile assembly is weight stable. The construction of each sabot segment, considered as a projectile itself, is stable with its original leading edge to the rear. Thus, as the segments open and begin to depart from the projectile, they will continue to turn outward and not disrupt the stabilizing airflow over the projectile 10.

Referring now to FIGS. 6 and 7, improvements are shown to the fairly standardized sabot halves used in a variety of commercially available shotgun ammunition. In the embodiment depicted, two holes or air passages 26 and 27 are found in each sabot half. FIG. 6 shows the interior wall of a sabot half as it would lie, on its rounded outer surface, again showing the forward and rear vents.

Referring to FIG. 7, the forward air vent 26 is found to start near the leading edge of the sabot half and to extend throughout the body of the sabot half at approximately a 45 degree angle to the inner wall of the sabot half. The rearward air vent 28, is of somewhat larger diameter, and is found to originate on the inner wall of the sabot half just rearwardly of the forward air vent 26. FIGS. 6 and 7 show the diameter of the rearward air vent to be approximately twice the diameter of the forward air vent, although this ratio can vary somewhat and remain effective. The rear air vent 28 extends rearwardly, again at approximately a 45 degree angle, and exits the sabot half on its outer wall as shown.

These air vents, 26 and 28, assist in the clean and quick release of the sabot segments from the tubular projectile. Because the projectile is tubular and therefore has a reduced frontal area due to the central passageway, the amount of air pressure typically built up with solid sabot projectiles is not found. Therefore in order to ensure effective separation of sabot segments, these air passageways have been incorporated into the sabot design.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. An elongate tubular projectile with a longitudinal centre axis having a generally cylindrical body with an outer diameter D2 having a leading end and a base, said leading end being generally flat with a rounded corner, said body being radially constricted at a transverse plane closer to the base than the leading end, said body having a forward divergent body section, diverging from said transverse plane outwardly and forwardly towards the leading end, and a rearward divergent body section diverging outwardly and rearwardly from said plane towards the base, said forward divergent body section and said rearward divergent body section together extending over a majority of the overall length of said tubular projectile, said tubular projectile having an axial passageway having a generally conical forward throat section of decreasing cross-sectional area, a central section with a smooth straight cylindrical inner surface of constant cross-sectional area which defines an inner diameter D1 of the projectile and which extends over a majority of the overall length of said tubular projectile, and a generally conical rearward diffuser section of increasing cross-sectional area, and wherein said throat section commences at the leading end at a point substantially midway between the outer diameter and the inner diameter of said tubular projectile.

2. A tubular projectile as defined in claim 1, having said forward and rearward divergent body sections terminating in short cylindrical body portions adjacent the leading end and the base.

3. A tubular projectile as defined in claim 1, having at least two narrow longitudinal expansion slots spaced equally apart, starting at the leading end of the tubular projectile and extending rearwardly, said slots being cut completely through a wall of the tubular projectile.

4. A tubular projectile as defined in claim 3, wherein the number of slots is four.

5. A tubular projectile as defined in claim 2, having at least two narrow longitudinal expansion slots spaced equally apart, starting at the leading end of the tubular projectile and extending rearwardly, through the short cylindrical body portion adjacent the leading end and just into the forward divergent body section of the tubular projectile, said slots being cut completely through a wall of the tubular projectile.

6. A tubular projectile as defined in claim 5, wherein the number of slots is four.

7. A tubular projectile as defined in claim 1, in which the centre of gravity of the tubular projectile is positioned forwardly of the geometric centre thereof.

8. A tubular projectile as defined in claim 1, in which said divergent body sections converge at a diametrically restricted waist portion disposed rearwardly of the centre of gravity of the tubular projectile.

9. A sabot projectile assembly comprising: an elongate tubular projectile with a longitudinal centre axis having a generally cylindrical body with an outer diameter D2 having a leading end and a base, said leading end being generally flat with a rounded corner, said body being radially constricted at a transverse plane closer to the base than the leading end, said body having a forward divergent body section, diverging from said transverse plane outwardly and forwardly towards the leading end, and a rearward divergent body section diverging outwardly and rearwardly from said plane towards the base, said forward divergent body section and said rearward divergent body section together extending over a majority of the overall length of said tubular projectile, said tubular projectile having an axial passageway having a generally conical forward throat section of decreasing cross-sectional area, a central section with a smooth straight cylindrical inner surface of constant cross-sectional area which defines an inner diameter D1 of the projectile and which extends over a majority of the overall length of said tubular projectile, and a generally conical rearward diffuser section of increasing cross-sectional area, and wherein said throat section commences at the leading end at a point substantially midway between the outer diameter and the inner diameter of said tubular projectile, said sabot projectile assembly further comprising a plurality of sabot segments, said segments generally axially contacting said tubular projectile, said tubular projectile further comprising axially spaced outer surface portions defining at least two axial load receiving means, each of the said segments having axially spaced inner surface portions defining at least two axial load transfer means, said inner and outer surface portions complementary to and contacting with each other to provide for relative wedging movement therebetween, the arrangement being such that the segments will be wedged outwardly from the tubular projectile upon relative rearwardly or forwardly movement between the tubular projectile and segments.

10. A sabot projectile assembly as defined in claim 9, in which said sabot segments define at one end thereof a generally annular base and said tubular projectile has a transaxial base coplanar with said annular base of said segments.

11. A sabot projectile assembly as defined in claim 9, in which said sabot segments define at an end near the leading end of the tubular projectile, a shoulder radially spaced from a forward end of the tubular projectile whereby said spacing promotes said segments to readily fall away from the tubular projectile after exiting from a muzzle without disturbing the airflow over the tubular projectile.

12. A sabot projectile assembly as defined in claim 9, in which each of said sabot segments includes at least one forward air vent near its leading end, said air vent having an opening on an outer wall of the sabot segment, said air vent extending rearwardly and inwardly at an angle from an outer surface of the segment to the inner surface of the segment to permit air to flow through said vent assisting in the separation of the sabot segment from the tubular projectile.

13. A sabot projectile assembly as defined in claim 12, wherein a second rear air vent is placed behind said first forward air vent, said second air vent commencing on the inner surface of the sabot segment just rearwardly of the point at which the forward air vent exits the inner surface, said rear air vent extending outwardly and rearwardly at an angle and passing through the outer wall of the sabot segment.

14. A sabot projectile assembly as defined in claim 13, wherein the diameter of the rearward air vent is larger than the diameter of the forward air vent.

15. A sabot projectile assembly as defined in claim 13, wherein the diameter of the rearward air vent is approximately twice the diameter of the forward air vent.

* * * * *